US009273662B2

(12) United States Patent
Halbrock et al.

(10) Patent No.: US 9,273,662 B2
(45) Date of Patent: Mar. 1, 2016

(54) GLOW PLUG CONTROL DEVICE

(71) Applicant: BorgWarner BERU Systems GmbH, Ludwigsburg (DE)

(72) Inventors: Bernd Halbrock, Königsbach-Stein (DE); Michael Störzinger, Bretten (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 74 days.

(21) Appl. No.: 14/221,767

(22) Filed: Mar. 21, 2014

(65) Prior Publication Data

US 2014/0291314 A1 Oct. 2, 2014

(30) Foreign Application Priority Data

Mar. 26, 2013 (DE) ..... 10 2013 103 090

(51) Int. Cl.
*H05B 1/02* (2006.01)
*F02P 19/02* (2006.01)

(52) U.S. Cl.
CPC ..... *F02P 19/022* (2013.01); *F02P 19/023* (2013.01)

(58) Field of Classification Search
CPC ..... H05B 2203/027; F02P 19/022; F02P 19/023; F02P 19/02; F02P 19/025
USPC ..... 219/494, 497, 501, 209, 505, 504; 123/145 A
See application file for complete search history.

(56) References Cited

U.S. PATENT DOCUMENTS 4,348,583 A * 9/1982 Bube et al. ..... 219/497
4,594,975 A * 6/1986 Shigenobu ..... 123/179.21
6,148,258 A 11/2000 Boisvert et al.
6,392,206 B1 * 5/2002 Von Arx et al. ..... 219/468.1
6,409,969 B1 * 6/2002 Streicher et al. ..... 422/94
8,319,499 B2 11/2012 Gronwald et al.
8,598,976 B2 12/2013 Hetzler
2001/0019276 A1 * 9/2001 Yoshida et al. ..... 324/754
2006/0209137 A1 * 9/2006 Kojima et al. ..... 347/68
2008/0265398 A1 * 10/2008 Matsumoto et al. ..... 257/697

FOREIGN PATENT DOCUMENTS

DE 10 2009 051 632 A1 5/2011
DE 10 2007 033 182 B4 11/2012
EP 1 517 405 A1 3/2005
EP 2 274 749 B1 8/2011
JP 2007-165003 A 6/2007
JP 2009-009638 A 1/2009

OTHER PUBLICATIONS

BorgWarner: Alles über Glühkerzen, Technische Information Nr. 04.

* cited by examiner

*Primary Examiner* — Mark Paschall
(74) *Attorney, Agent, or Firm* — Bose McKinney & Evans LLP

(57) ABSTRACT

The invention relates to a glow plug control device comprising a power transistor for switching the heating current on and off, a control unit for controlling the power transistor, a measuring resistor connected in series with the power transistor for measuring the intensity of a heating current, and a circuit board, which carries the power transistor, the control unit and the measuring resistor. The measuring resistor is connected to the circuit board via pins which are pressed into circuit board holes and which are made of an alloy that has a copper content of at least 80% by weight and a nickel content from 4 to 12% by weight. This disclosure also relates to the use of an alloy having a copper content of at least 80% by weight and a nickel content from 4 to 12% by weight for a pin of a press-in connection in a glow plug control device.

11 Claims, 1 Drawing Sheet

GLOW PLUG CONTROL DEVICE

RELATED APPLICATIONS

This application claims priority to DE 10 2013 103 090.4, filed Mar. 26, 2013, the entire disclosure of which is hereby incorporated herein by reference in its entirety.

BACKGROUND

The invention relates to a glow plug control device. Modern glow plug control devices generate an effective voltage for each glow plug from an on-board power supply voltage of a motor vehicle by means of pulse-width modulation. Glow plug control devices therefore contain a power transistor, with which the heating current is switched on and off and is thus pulse-width-modulated.

Glow plug control devices can control the temperature of a glow plug by adapting the duty cycle of the pulse-width-modulated effective voltage. A precise control of the fed power is necessary for precise temperature control. For a closed-loop control of the temperature, the present temperature of the glow plug is established from a resistance measurement. Both for open and closed-loop control a precise measurement of the intensity of the heating current is of great significance. Many modern glow plug control devices therefore contain a measuring resistor for measuring the strength of the heating current.

A constant objective when developing glow plug control devices is to bring a glow plug as quickly as possible to a desired temperature and to keep it there with great accuracy. Excessively high temperatures of a glow plug lead to the premature failure thereof. Too low temperatures lead to a sub-optimal combustion of the fuel.

SUMMARY

The present invention provides a way in which the temperature of a glow plug can be controlled more accurately with a glow plug control device.

With conventional glow plug control devices the measuring resistor is soldered to the circuit board. Within the scope of this disclosure it has been found that the temperature dependency of the electrical resistance of such a soldered connection constitutes a significant error source for an accurate power or temperature control of the glow plug, since the temperature-dependent resistance of the soldered connection adds to the resistance value of the measuring resistor.

Press-fit connections are known as alternatives to soldered connections. Press-in pins for this purpose are made of bronze, brass or copper irons. However, these materials also have a significant temperature-dependent resistance, and therefore the problem of a temperature-dependent interference signal cannot be effectively solved in this way.

In accordance with this disclosure the press-fit connection is formed by pins that are made of an alloy which has a copper content of at least 80% by weight and a nickel content from 4 to 12% by weight. Copper-nickel alloys of this type have a low temperature-dependence of the resistance in combination with very good mechanical properties, in particular a resilient elasticity, which enables good press-fit connections.

In accordance with an advantageous refinement of this disclosure the alloy used for the pin has a copper content of at least 85% by weight. For example, the alloy can have a copper content of 88% by weight or more.

In accordance with a further advantageous refinement of this disclosure the alloy used for the pin contains less than 10% by weight, preferably less than 5% by weight, in particular less than 3% by weight, of other alloy constituents. For example, copper-nickel alloys that contain no more than 2% by weight of other alloy constituents are well suited.

In accordance with a further advantageous refinement of this disclosure the alloy has a nickel content from 6 to 10% by weight, preferably from 8 to 10% by weight.

Should the alloy contain further constituents besides copper and nickel, these further constituents should account for only a small proportion. The alloy, apart from copper and nickel, preferably does not contain any alloy constituent that accounts for a proportion of more than 2% by weight.

Tin for example, preferably no more than 2% by weight, or other metals, for example iron and/or manganese, may be contained as further alloy constituents besides copper and nickel. Should the alloy contain elements other than nickel, copper or tin, each of these other elements preferably accounts for a proportion of no more than 1% by weight.

The pin used for the press-fit connections may have an opening. Pins of this type have an eye, similar to a needle, and can be easily compressed as the pins are pressed in. Solid pins can also be used alternatively.

BRIEF DESCRIPTION OF THE DRAWINGS

Further details and advantages of these teachings will be explained on the basis of an illustrative embodiment with reference to the accompanying drawings, in which.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
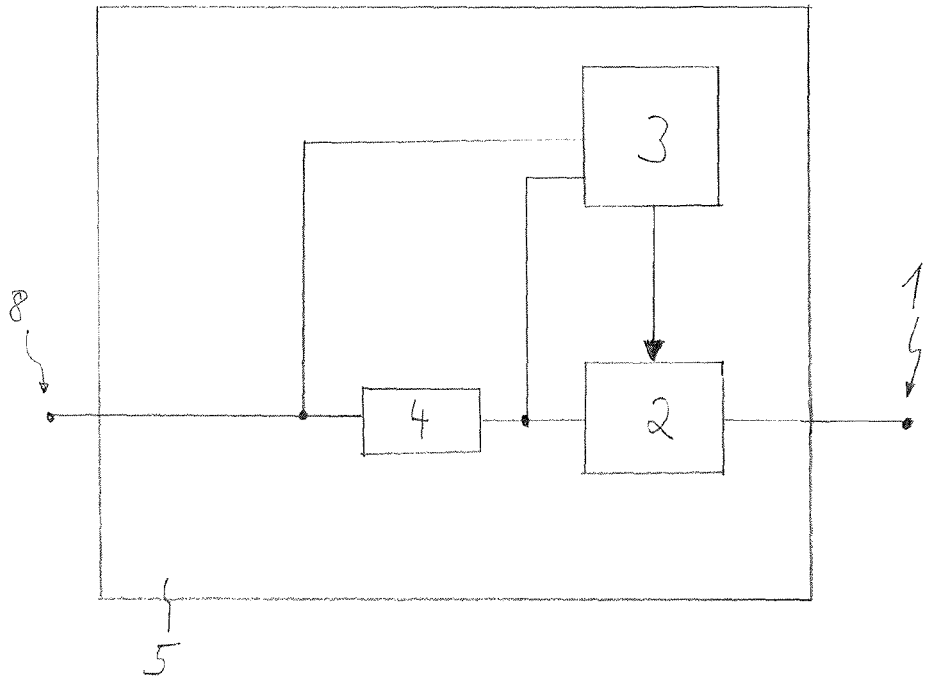
FIG. 1 shows a schematic illustration of a glow plug control device.

A simplified illustration of a glow plug control device is illustrated in FIG. 1, said glow plug control device comprising a plug connector connection 1 for connection of a glow plug, a power transistor 2 as a semiconductor switch for switching a heating current on and off, a control unit 3 for controlling the power transistor 2, and a measuring resistor 4 for measuring the intensity of the heating current. The plug connector connection 1 is attached to a housing, which is not illustrated in FIG. 1 and in which the power transistor 2, the control unit 3 and the measuring resistor 4 are arranged. The housing additionally has a connection in order to connect the glow plug control device to the on-board power supply of a vehicle.

The glow plug control device actually has a plurality of connections for connection of a glow plug, however these are not illustrated for reasons of clarity. Each of these plug connector connections 1 is connected in series with a power transistor 2, for example a field-effect transistor. Each of the power transistors 2 is connected in series with a measuring resistor 4 for measuring the heating current flowing through the power transistor.

All power transistors 2 are controlled by the control unit 3, which for example may be an ASIC or a microcontroller. The control unit 3 measures the electric potential before and after the measuring resistor 4 in order to establish the voltage drop across the measuring resistor 4. From this voltage drop and the resistance value of the measuring resistor 4, the control unit 3 can measure the intensity of the current flowing through the measuring resistor 4 and therefore the intensity of the heating current.

The power transistor 2, the control unit 3 and the measuring resistor 4 are arranged on a circuit board 5. Circuit boards are sometimes referred to as circuit carrier plates.

Figure 2:
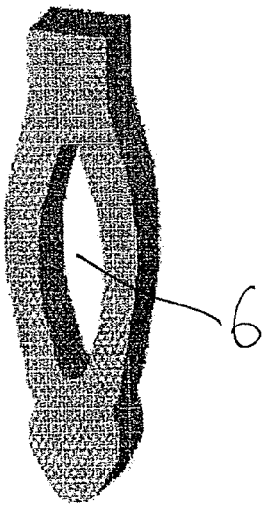
FIG. 2 shows an illustrative embodiment of a press-in pin.
Figure 3:
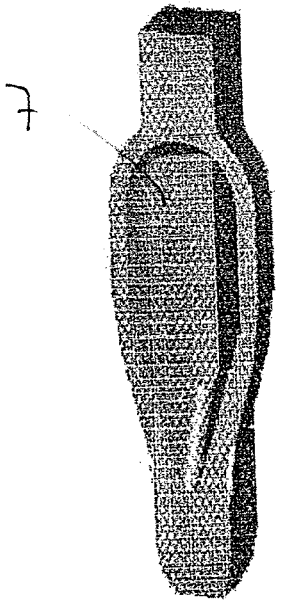
FIG. 3 shows a further illustrative embodiment of a press-in pin

The measuring resistor 4 is connected via pins to the circuit board 5, said pins being pressed into the circuit board holes. Illustrative embodiments of such pins are illustrated in FIG. 2 and FIG. 3. The heating current thus flows through two press-fit connections and the measuring resistor 4. The pins each have a bulged middle part. In the example of FIG. 2 the middle part has an opening 6. In the example of FIG. 3 both the width and the thickness of the pin are increased in the middle part.

The pins with which the measuring resistor 4 is fastened to the circuit board 5 are made of an alloy that has a copper content of at least 80% by weight and a nickel content from 4 to 12% by weight. The pins may consist, for example, of CuNi6, CuNi10, CuNi10Fe1Mn or CuNi9Sn2.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

What is claimed is:

1. A glow plug control device, comprising:

a power transistor for switching heating current on and off;

a control unit for controlling the power transistor;

a measuring resistor connected in series with the power transistor for measuring the intensity of a heating current; and a circuit board, which carries the power transistor, the control unit and the measuring resistor;

wherein the measuring resistor is connected to the circuit board via pins which are press-fit into circuit board holes and which are made of an alloy that has a copper content of at least 80% by weight and a nickel content from 4 to 12% by weight;

whereby the change in resistance of the pins as a function of temperature is low and the mechanical properties of the pins are enhanced for a press-fit connection.

2. The glow plug control device according to claim 1, wherein the alloy has a copper content of at least 85% by weight.

3. The glow plug control device according to claim 1, wherein the alloy has a copper content of at least 88% by weight.

4. The glow plug control device according to claim 1, wherein the alloy contains less than 10% by weight of other alloy constituents.

5. The glow plug control device according to claim 1, wherein the alloy contains less than 5% by weight of other alloy constituents.

6. The glow plug control device according to claim 1, wherein the alloy contains less than 3% by weight of other alloy constituents.

7. The glow plug control device according to claim 1, wherein the alloy has a nickel content from 6 to 10% by weight.

8. The glow plug control device according to claim 1, wherein the alloy has a nickel content from 8 to 10% by weight.

9. The glow plug control device according to claim 1, wherein the alloy is CuNi6, CuNi10, CuNi10Fe1Mn or CuNi9Sn2.

10. The glow plug control device according to claim 1, wherein the alloy does not contain any alloy constituent in an amount greater than 2% by weight other than copper and nickel.

11. The glow plug control device according to claim 1, wherein the pins have an opening that is compressed as the pins are pressed in.

* * * * *